US005617889A

United States Patent [19]

Wu

[11] Patent Number: 5,617,889

[45] Date of Patent: Apr. 8, 1997

[54] MULTIPLE-FOLD AUTOMATIC UMBRELLA WITH REINFORCED RIBS AND SIMPLIFIED MECHANISM

[76] Inventor: Woh-Wen Wu, P.O. Box 10160, Taipai, Taiwan

[21] Appl. No.: 654,142

[22] Filed: May 28, 1996

[51] Int. Cl.[6] ..... A45B 25/14

[52] U.S. Cl. ..... 135/22; 135/24; 135/25.3

[58] Field of Search ..... 135/22, 24, 25.1, 135/25.3, 25.31, 29, 27, 31, 32

[56] References Cited

U.S. PATENT DOCUMENTS

| | | | |
|---|---|---|---|
| 4,682,616 | 7/1987 | Schultes | 135/22 X |
| 4,989,625 | 2/1991 | Wu | 135/24 X |
| 5,144,969 | 9/1992 | Chou et al. . | |
| 5,178,174 | 1/1993 | Wu | 135/24 X |
| 5,267,583 | 12/1993 | Wu . | |
| 5,309,932 | 5/1994 | Chou et al. . | |
| 5,441,065 | 8/1995 | Lin et al. | 135/24 |
| 5,492,140 | 2/1996 | Lin et al. | 135/24 |
| 5,505,222 | 4/1996 | Lin et al. | 135/24 |

*Primary Examiner*—Lanna Mai

[57] ABSTRACT

An automatic umbrella includes a closing controller formed as a pushing rod pivotally connected on a push button of a control device for disengaging a locking head of the rope for closing the umbrella from its opening state upon depression of the push button, with the pushing rod being biased as downwardly thrusted by a middle tubular shaft when folding the umbrella for preventing an unexpected closing operation after opening the umbrella. The rope of the umbrella control device has an integrally formed roller holder for pivotally securing a roller on the holder for guiding the rope, with the integrally formed roller holder embedded in a lower runner of the rib assembly for reducing the assembly cost. The rib assembly includes an outer joint member for pivotally connecting the outer ribs having a pair of elongated lugs of an the outer joint member operatively clamping an outer pressed end portion of a middle rib within the elongated lugs of the outer joint member for stabilizing the outer ribs of the rib assembly when opening the umbrella; and a top rib having an outer bending edge portion bent downwardly from an outer end of the top rib to be spaced between two side walls of the U-shaped top rib to prevent the collapse or deformation of the top rib for prolonging its service life.

4 Claims, 7 Drawing Sheets

W
26
27
272
271
252
7
8
2
25
25a
251
28
11
222
22a
62
6
61
22
23
221
1
21
24
273
9
10
274
270
221a

MULTIPLE-FOLD AUTOMATIC UMBRELLA WITH REINFORCED RIBS AND SIMPLIFIED MECHANISM

BACKGROUND OF THE INVENTION

U.S. Pat. No. 5,267,583 entitled "Multiple-fold Automatic Umbrella Controlled by Single Push Button" issued to the same inventor of the co-inventors of this application disclosed an automatic umbrella having a push button which may be depressed to open and close the umbrella. However, the structure of the control means and the relevant elements are complex and inconveniently operated, thereby requiring a simplification and modification for improving their mechanism and operation.

The conventional joints for the ribs of an automatic umbrella (prior arts) as shown in FIGS. 12–15 are not strong enough to resist a strong wind or external force, easily damaging the ribs.

As shown in FIGS. 12, 13, a conventional joint member 27 is provided for connecting the rear rib 26, the resilient rib 25*a* and the middle rib 25, having a front bifurcated fork 270 for pivotally connecting an outer end of the resilient rib 25*a*, and having a pressed outer end 252 of the middle rib 25 pivotally connected with a pair of lugs 271. Since, the lugs 271 of the joint 27 are not long enough to embed or "clamp" the outer end 252 of the middle rib 25 within the joint 27, the front fork 270 as connected with the resilient rod 25*a* may be twisted either rightwardly or leftwardly when subjected to a strong wind force, easily deforming and damaging the umbrella ribs.

As shown in FIGS. 14, 15, a pair of outer fork ends 222 of the top rib 22 having a U-shaped cross section is not reinforced with any packing or retainer between the two fork ends 222, thereby being easily deformed and damaged to influence the smooth operation of the umbrella and to shorten the service life of the umbrella.

The present inventors have found the drawbacks of the conventional automatic umbrella and invented the present umbrella with simplified mechanism and reinforced ribs.

SUMMARY OF THE INVENTION

One object of the present invention is to provide an automatic umbrella including a closing controller formed as a pushing rod pivotally connected on the push button for disengaging a locking head of the rope for closing the umbrella from its opening state upon depression of the push button, with the pushing rod being biased as downwardly thrusted by a middle tubular shaft when folding the umbrella for preventing an unexpected closing operation after opening the umbrella.

Another object of the present invention is to provide an integrally formed roller holder for pivotally securing a roller on the holder for guiding the rope of the control means, with the integrally formed roller holder embedded in a lower runner of the rib assembly for reducing the assembly cost.

Still another object of the present invention is to provide a reinforced rib means having a pair of elongated lugs of an outer joint member for clamping an outer pressed end portion of a middle rib within the elongated lugs of the outer joint member for stabilizing the outer ribs of the rib assembly when opening the umbrella; and a top rib having an outer bending edge portion bent downwardly from an outer end of the top rib to be spaced between the two side walls of the U-shaped top rib to prevent the collapse or deformation of the top rib for prolonging its service life.

Other objects of the present invention will be further described hereinafter.

DETAILED DESCRIPTION

Figure 1:
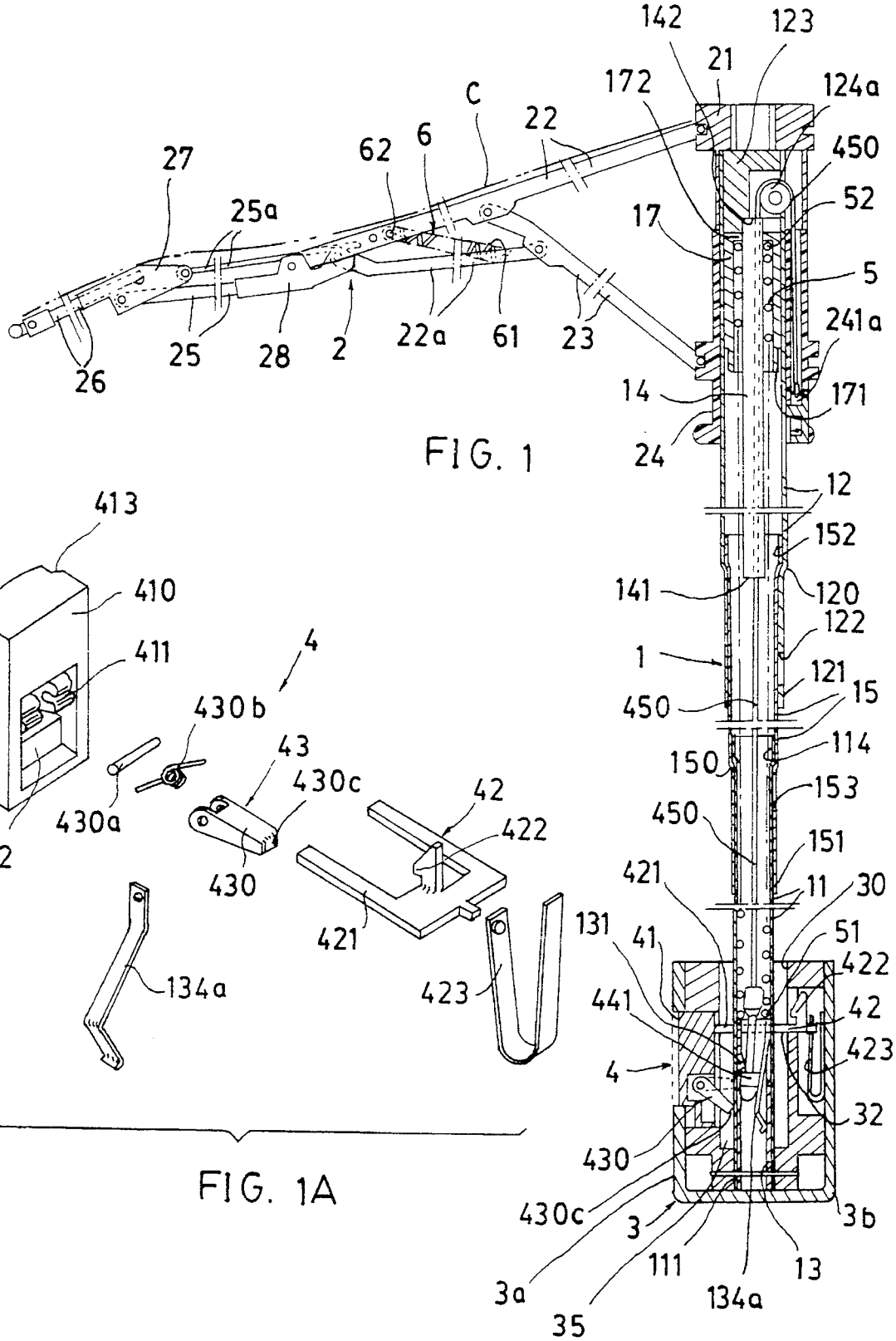
FIG. 1 is an illustration showing an opened umbrella in accordance with the present invention.
Figure 1A:
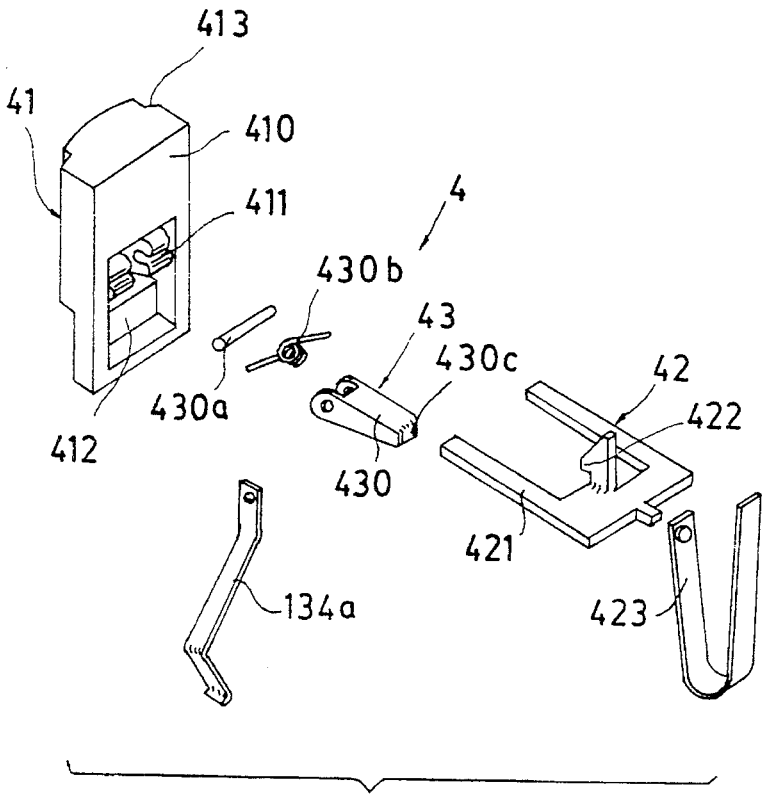
FIG. 1A is an exploded view of the elements of the control means of the present invention.

As shown in FIGS. 1–11, the present invention comprises: a central shaft means 1, a rib assembly 2 for securing an umbrella cloth C on the rib assembly 2, a grip 3, a control means 4, an extending (or opening) spring 5, and a plurality of retraction restoring (or closing) springs 6.

Figure 3:
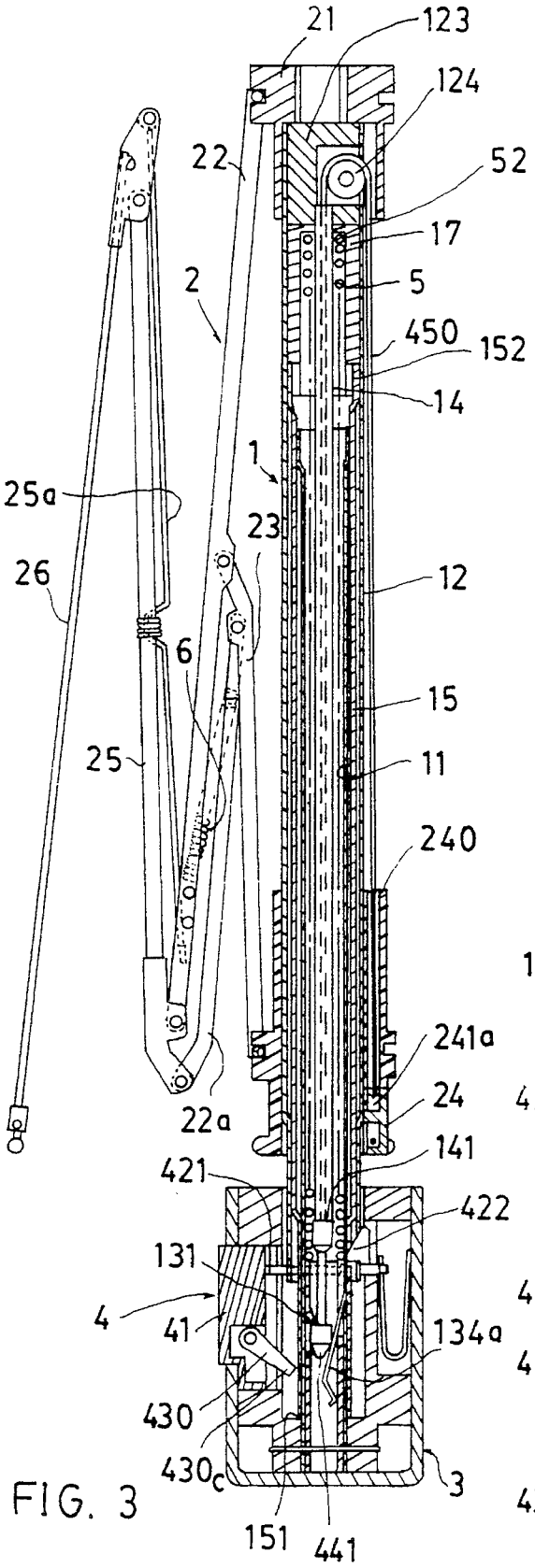
FIG. 3 shows a folded umbrella after resetting its spring energy.
Figure 3B:
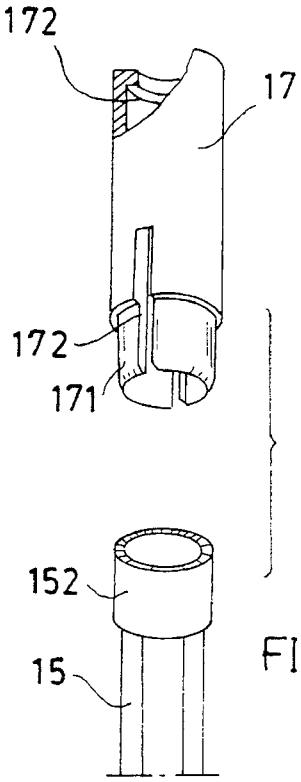
FIG. 3B shows a coupling sleeve with the middle tubular shaft of the present invention.

The central shaft means 1 includes; a lower tubular shaft 11 having a lower end portion 111 fixed in the grip 3 having a rod hole 112 formed in the lower end portion 111 at a first side 3*a* of the grip 3 and an upper enlarged portion 114 formed on an upper portion of the lower shaft 11; a middle tubular shaft 15 slidably engageable with the lower shaft 11 having a lower end portion 151 tapered downwardly from a contraction portion 150 formed on a lower portion of the middle shaft 15 with the contraction portion 150 operatively coupled with the upper enlarged portion 114 of the lower shaft 11, having an upper enlarged portion 152 formed on an upper portion of the middle shaft 15 and an engaging hole 153 formed in a lower portion of the middle shaft 15; an upper tubular shaft 12 slidably engageable with the middle tubular shaft 15 having a contraction portion 120 formed on a lower portion of the upper shaft 12 to be operatively coupled with the upper enlarged portion 152 of the middle shaft 15, a lower end portion 121 tapered downwardly from the contraction portion 120 of the upper shaft 12, an engaging hole 122 formed in the lower end portion 21 of the upper shaft 12 at a second side 3*b* of the grip 3, and an upper inner block 123 formed in an upper end portion of the upper shaft 12 having a guiding roller 124*a* rotatably mounted in the inner block 123 or on the shaft 12; a lower sleeve 13 fixed in the grip 3 within the lower shaft 11, having a triangular block portion 131 formed in the lower sleeve 13 inclined inwardly downwardly, an inner rod hole 132 formed in the lower sleeve 13 positioned below the triangular block portion 131 adjacent to the rod hole 112 at a first side 3*a* of the grip 3, and an upper sleeve end portion 135 formed on an upper portion of the lower sleeve 13; an upper sleeve 14 having a lower sleeve end portion 141 protruding into the middle shaft 15 when opening the umbrella and having an upper sleeve end portion 142 fixed in the inner block 123 of the upper shaft 12 with the extending spring 5 jacketed on the upper sleeve 14 to be slidably engageable with the upper sleeve 14 to prevent tangling of the spring 5; a coupling sleeve 17 (especially as shown in FIG. 3B) having a lower fork portion 171 as bifurcated from the sleeve 17 by sloes 172 longitudinally formed in the lower portion of the sleeve 17, and an upper shoulder portion 172 to be retained by an upper spring end 52 of the opening spring 5, with the lower fork portion 171 detachably engageable with the upper enlarged portion 152 of the middle shaft 15; with the middle shaft 15 having the lower end portion 151 retained on a lower portion in the grip 3 and having the upper enlarged portion 152 engaged with the coupling sleeve 17 which is retained against the inner block 123 when resetting the folded umbrella as shown in FIG. 3.

The middle and lower shafts 15, 11 may have their lower shaft portions insertably retracted into a central hole 30 of the grip 3.

The rib assembly 2 includes: an upper notch 21 secured on a top portion of the upper shaft 12, a plurality of top ribs 22 each top rib 22 pivotally secured to the upper notch 21, a plurality of stretcher ribs 23 each stretcher rib 23 pivotally secured to each top rib 22 and a lower runner 24 slidably held on the middle and upper shafts 15, 12, a plurality of middle ribs 25 each middle rib 25 pivotally connected to the top rib 22 through a middle joint member 28, a plurality of outer ribs 26 each outer rib 26 having an inner end portion of the outer rib 26 secured to an outer joint member 27 which is pivotally connected with an outer end portion of each middle rib 25 and an outer end portion of a resilient rib 25*a*, and a plurality of connection ribs 22*a* each having its inner end portion pivotally secured to an outer end portion of each stretcher rib 23 and having an outer end portion of the connection rib 22*a* pivotally secured to the middle joint member 28 which is secured with the middle rib 25.

The top rib 22 has its middle portion pivotally secured with an outer end portion of the stretcher rib 23. The resilient rib 25*a* has its inner end secured to the outer portion of the top rib 22.

Figure 6C:
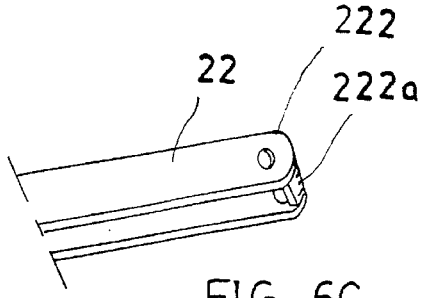
FIG. 6C shows a top rib of the present invention.
Figure 11:
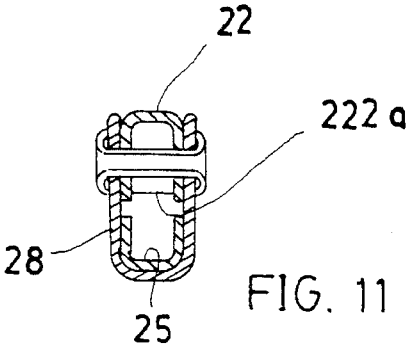
FIG. 11 is a cross sectional view as viewed from 11—11 direction of FIG. 6.
Figure 12:
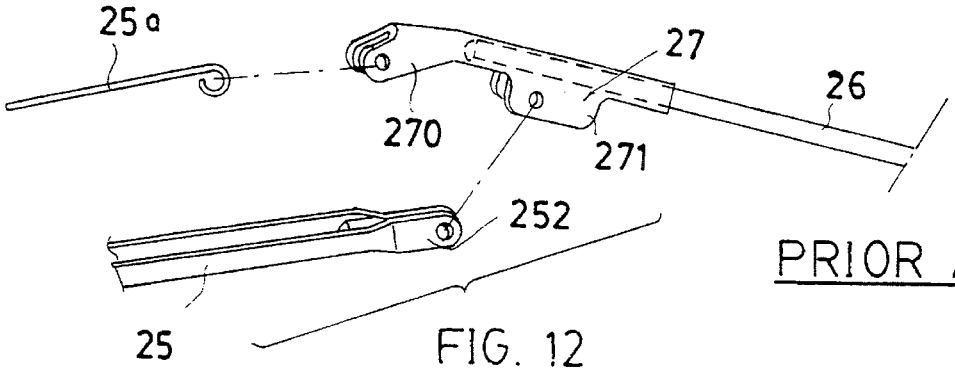
FIG. 12 PRIOR ART
FIG. 12 is an illustration showing an outer joint member with the ribs of a conventional umbrella.
Figure 13:
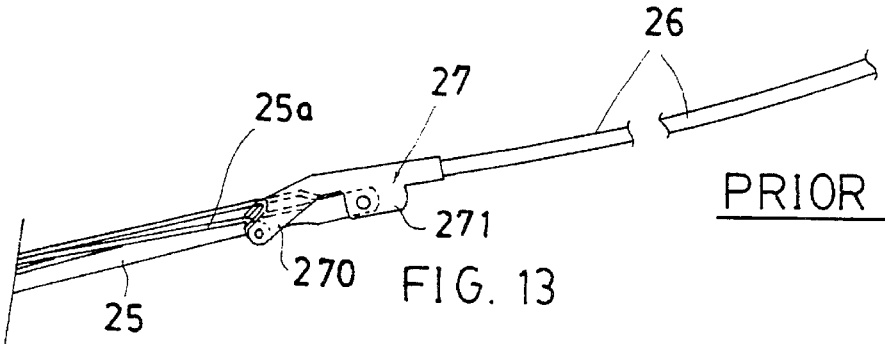
FIG. 13 PRIOR ART
FIG. 13 shows assembled ribs from FIG. 12.
Figure 14:
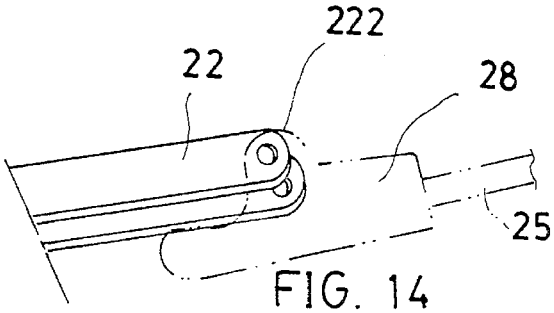
FIG. 14 PRIOR ART
FIG. 14 shows a conventional top rib not reinforced.
Figure 15:
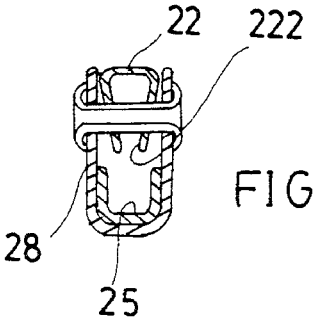
FIG. 15 PRIOR ART
FIG. 15 is a cross sectional view of the conventional top rib of FIG. 14.

The top rib 22 has an outer bending edge portion 222*a* bent downwardly as shown in FIGS. 6C and 11 from an outer end portion 222 of the top rib 22 having a cross section of U shape to be spaced between two longitudinal side walls of the U-shaped top rib 22 to reinforce the outer end portion 222 of the top rib 22 to prevent its collapse.

Figures 6, 6A, 6B, 7, 8, 9, 10:
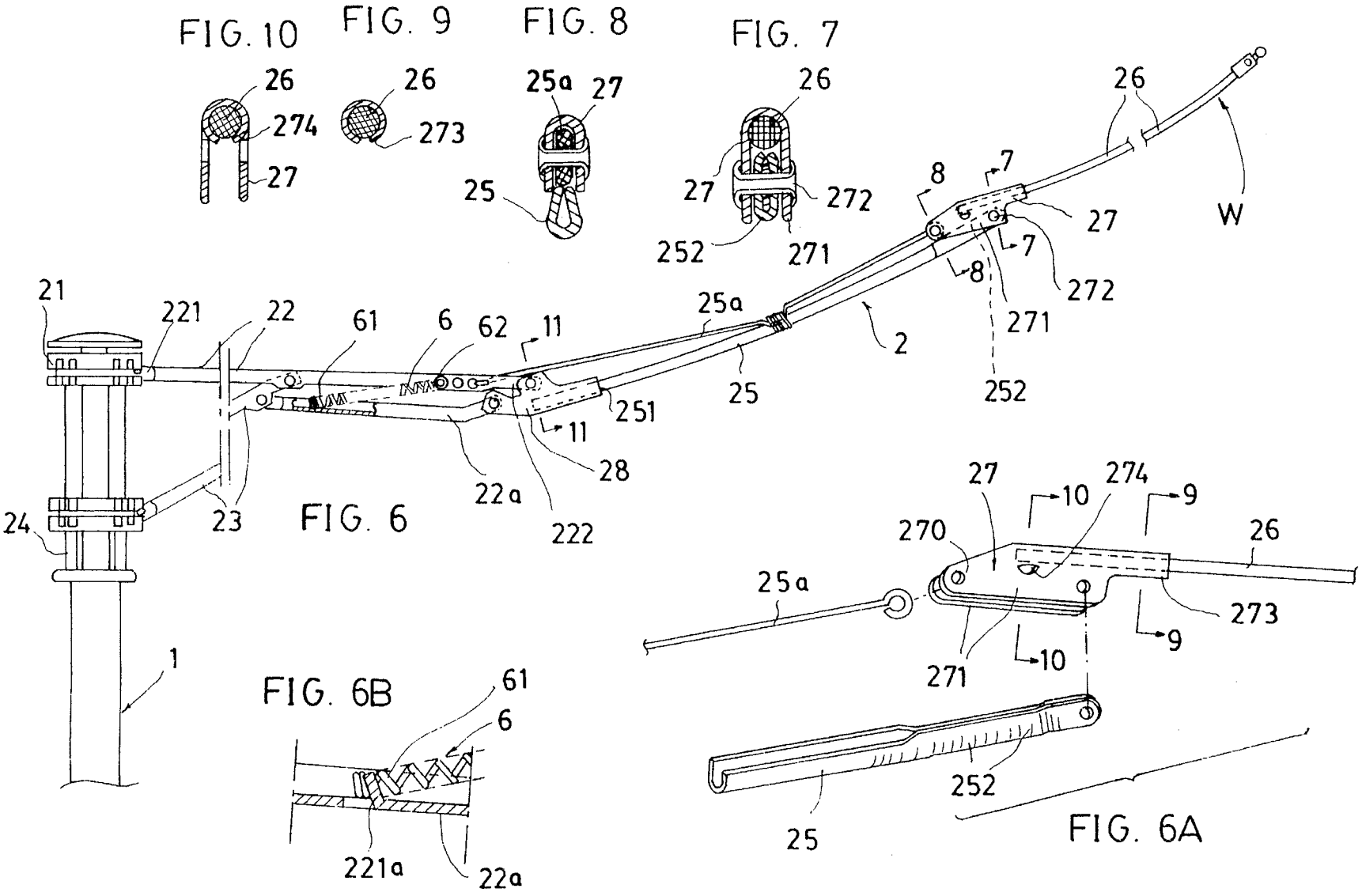
FIG. 6 is an illustration of an opened umbrella of the present invention as inverted upwardly (W) when subjected to wind force.
FIG. 6A is an illustration showing the outer joint members and the relevant ribs of the present invention.
FIG. 6B shows a fastening of a retraction spring on the ribs of the present invention.
FIG. 7 is a cross sectional view as viewed from 7—7 direction of FIG. 6.
FIG. 8 is a cross sectional view as viewed from 8—8 direction of FIG. 6.
FIG. 9 is a cross sectional view as viewed from 9—9 direction of FIG. 6A.
FIG. 10 is a cross sectional view as viewed from 10—10 direction of FIG. 6A.

The outer joint member 27 as shown in FIGS. 6–10 includes a pair of elongated lugs 271 bifurcated downwardly from the outer joint member 27 to clamp an outer pressed end portion 252 of the middle rib 25 pivotally connected to the outer joint member 27 by a pin 272, and a front fork portion 270 protruding forwardly from the outer joint member 27 for connecting an outer end of the resilient rib 25*a*. The pair of elongated lugs 271 holding the outer pressed end portion 252 of the middle rib 25 will prevent twisting of the rib assembly 2 for prolonging the service life of the rib assembly and the umbrella especially when subjected to a wind force W as shown in FIG. 6 even if the opened umbrella has been inverted upwardly under the strong wind force W (FIG. 6).

The joint member 27 may be punched to form a pair of crimped edge portions 273, 274 as shown in FIGS. 6, 9, 10 for fastening an inner rib portion of the rear rib 26 for preventing loosening or releasing of the rear rib 26 from the joint member 27.

Each retraction restoring or closing spring 6 has an inner spring end portion 61 secured to a lug 221*a* punched and formed on an inner portion of the connection rib 22*a* and an outer spring end portion 62 secured to an outer portion of the top rib 22 adjacent to the joint member 28 as shown in FIG. 6B.

The extending or opening spring 5 has its lower spring end portion 51 retained on the upper sleeve portion 135 of the lower sleeve 13 and an upper spring end portion 52 retained in the coupling sleeve 17 adjacent to the inner block 123 of the upper shaft 12.

The control means 4 includes: a push button 41, an opening controller 42, and a closing controller 43.

The push button 41 includes: a shoulder portion 413 slidably held in a button hole 31 formed in the grip 3 at the first side 3*a* of the grip 3, a pivot socket 411 recessed in an inside button surface 410 of the push button 41, and a recess 412 recessed in a lower button surface 410 of the button 41 for receiving a pushing rod 430 of the closing controller 43 as downwardly biased.

The opening controller 42 includes: a pair of bifurcated members 421 bifurcated forwardly towards the first side 3*a* of the grip 3 and slidably held in a middle transverse hole 32 formed in a central portion of the grip 3 to be normally contacting with the inside button surface 410 of the push button 41 and slidably disposing about an outer circumferential surface of the upper shaft 12, a wedge portion 422 tapered downwardly inwardly towards a center of the central shaft means 1 and secured to each rear portion of the bifurcated members 421, and a controller restoring spring 423 held in a spring socket 34 formed in the grip 3 at the second side 3*b* of the grip 3 for urging the wedge portion 422 through the middle transverse hole 32 to be engaged with the engaging holes 122, 153 of the upper and middle shafts 12, 15 when closing the umbrella, and also for urging the bifurcated members 421 forwardly to protrude the push button 41 outwardly ready for a depression operation.

Figure 2A:
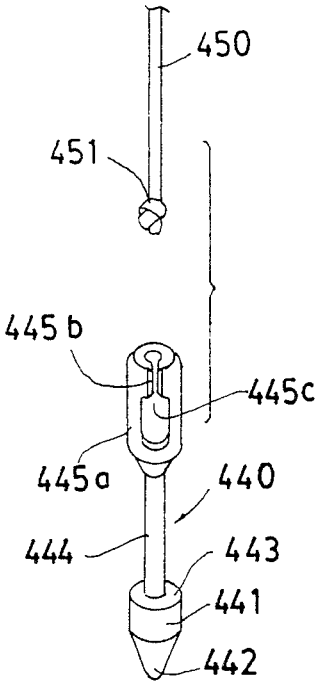
FIG. 2A is an illustration showing the coupling of the rope with the locking head means.
Figure 3A:
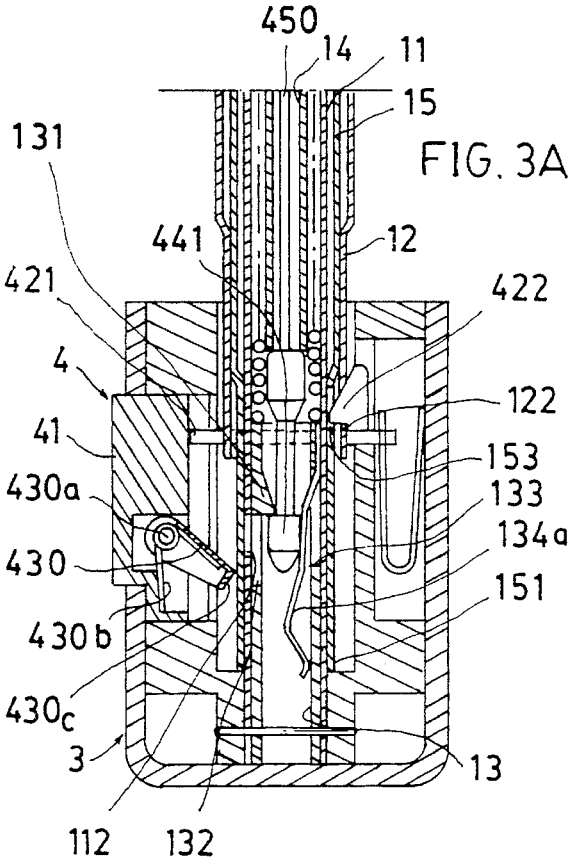
FIG. 3A is a partially enlarged view of the control means and the grip from FIG. 3.
Figure 4:
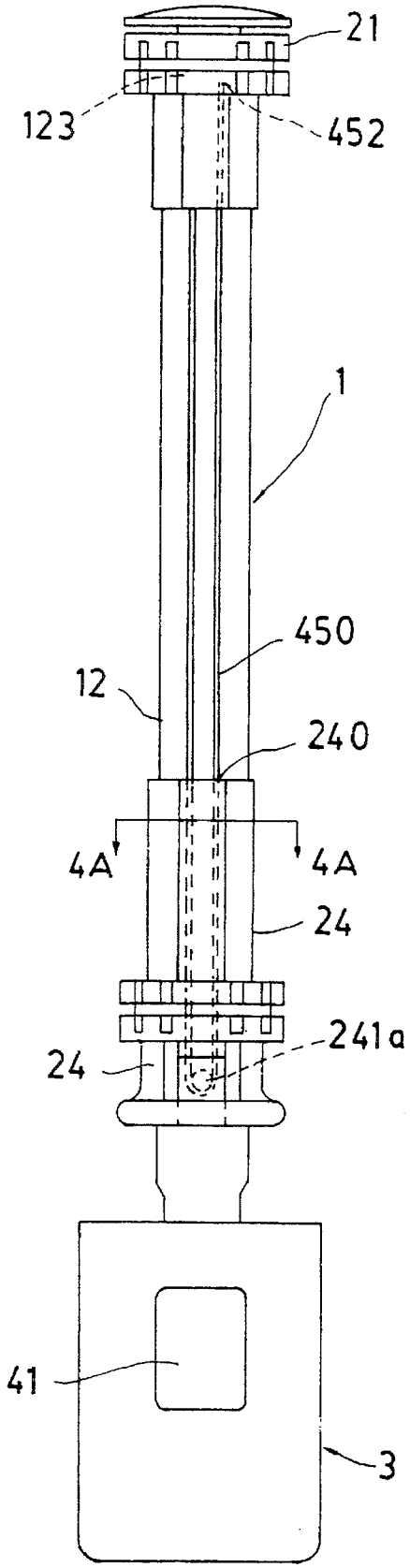
FIG. 4 is an illustration showing the relationship of the rope with the lower runner of the present invention.
Figure 4A:
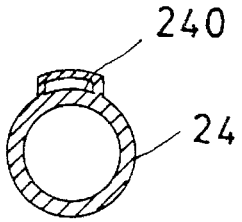
FIG. 4A is a cross sectional view as viewed from section 4A—4A of FIG. 4.
Figure 4C:
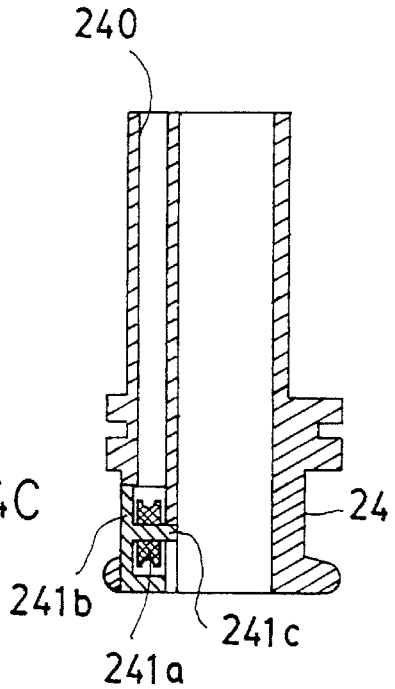
FIG. 4C is a longitudinal sectional drawing of the lower runner of the present invention.
Figure 4B:
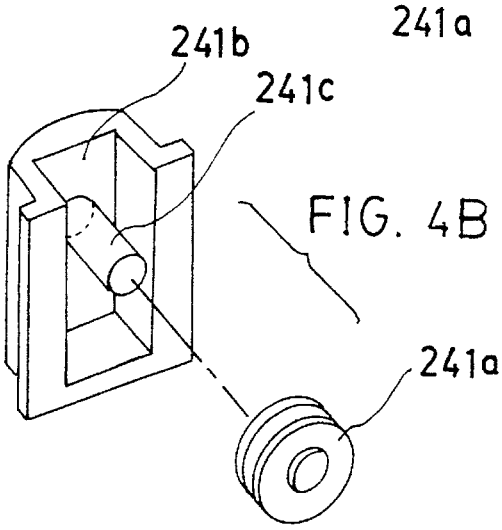
FIG. 4B is an illustration showing the roller and the roller holder.

The closing controller 43 includes: a pushing rod 430 pivotally mounted in the socket 411 of the push button 41 by a pivot 430*a* and normally restored horizontally by a restoring spring 430*b* to protrude from the inside button surface 410 towards the second side 3*b* of the grip 3 having an arcuate tip end 430*c* formed on an inner end of the rod 430 which is operatively depressed downwardly by the lower end portion 151 of the middle shaft 15 when resetting the folded umbrella as shown in FIGS. 3, 3A; a locking head means 440 (FIG. 2A) having a locking head portion 441 formed with an arcuate bottom portion 442 on a bottom portion of the locking head portion 441 and a locking shoulder portion 443 on an upper portion of the locking head portion 441, and a rope connector 445*a* secured with the locking head portion 441 with a neck portion 444 between the rope connector 445*a* and the locking head portion 441 having a knot socket 445*c* recessed in the connector 445*a* and a slit 445*b* cut in the connector 445*a* to communicate with the knot socket 445*c;* and a rope 450 having a lower rope knot 451 locked into the knot socket 445*c* in the connector 445*a* of the locking head means 440 by passing the rope 450 through the slit 445*b* and having an upper rope end portion 452 secured to the inner block 123 adjacent to the upper notch 21 by passing the rope 450 through a central portion of the shaft means 1, the upper sleeve 14 and deflectively winding the rope 450 on the upper guiding roller 124*a* formed on the inner block 123 downwardly to the lower runner 24 and then deflectively winding the rope upwardly through a lower guiding roller 241*a* pivotally secured in an integrally formed roller holder 241*b* having a roller shaft 241*c* integrally formed in the holder 241*b* for rotatably mounting the roller 241*a* thereon, with the roller holder 241*b* embedded in a bottom hole formed in the lower runner 24 to be upwardly extended to the inner block 123 adjacent to the upper notch 21 as shown in FIGS. 3, 4, 4A, 4B and 4C. The rope 450 may be guided in a rope channel 240 formed in the runner 24. The locking head portion 441 provided with the arcuate bottom portion 442 as universally held on a lower sleeve end 141 will be biased by a resilient plate 134*a* protruding towards the first side 3*a* when lowered in the lower sleeve 13 when resetting and folding the umbrella as shown in FIG. 3 to be locked on the triangular block portion 131 (which is pressed inwardly and directly formed in the inner shaft 11), with the resilient plate 134*a* integrally formed in the sleeve 13 as cut from a cut-out hole 133 in the sleeve 13 from the second side 3B of the grip 3. The locking head portion 441 may also be disengaged from the triangular block portion 131 when inwardly pushed by the pushing rod 430 as shown in dotted line of FIG. 1 for closing the umbrella from its opened state.

As shown in FIG. 1 for opening the umbrella of the present invention, the push button 41 is depressed to urge the bifurcated members 421 to retract the wedge portion 422 to disengage the engaging holes 122, 153 of the upper and middle shafts 12, 15 and the extending spring 5 will urge the coupling sleeve 17 upwardly to simultaneously "drag" the upper portion 152 of the middle shaft 15 to thus pull the middle shaft 15 upwardly, until the lower contraction portion 150 of the middle shaft 14 engages the upper enlarged portion 114 of the lower shaft 11. The rib assembly 2 and the umbrella cloth C are also extended to open the umbrella as shown in FIG. 1. Meanwhile, the lower runner 24 is slid upwardly along the central shaft means 1 to thereby tension the rope 450 among the upper notch 21, the lower runner 24 and the locking head means 440, of which the locking head portion 441 is engaged and locked at the triangular block portion 131 of the lower sleeve 13. Each retraction restoring spring 6 is tensioned when opening the umbrella for storing a potential restoring elastic energy of the spring 6, ready for a restoring retraction of the ribs 2 for lowering the lower runner 24 for folding or closing the umbrella.

Figure 2:
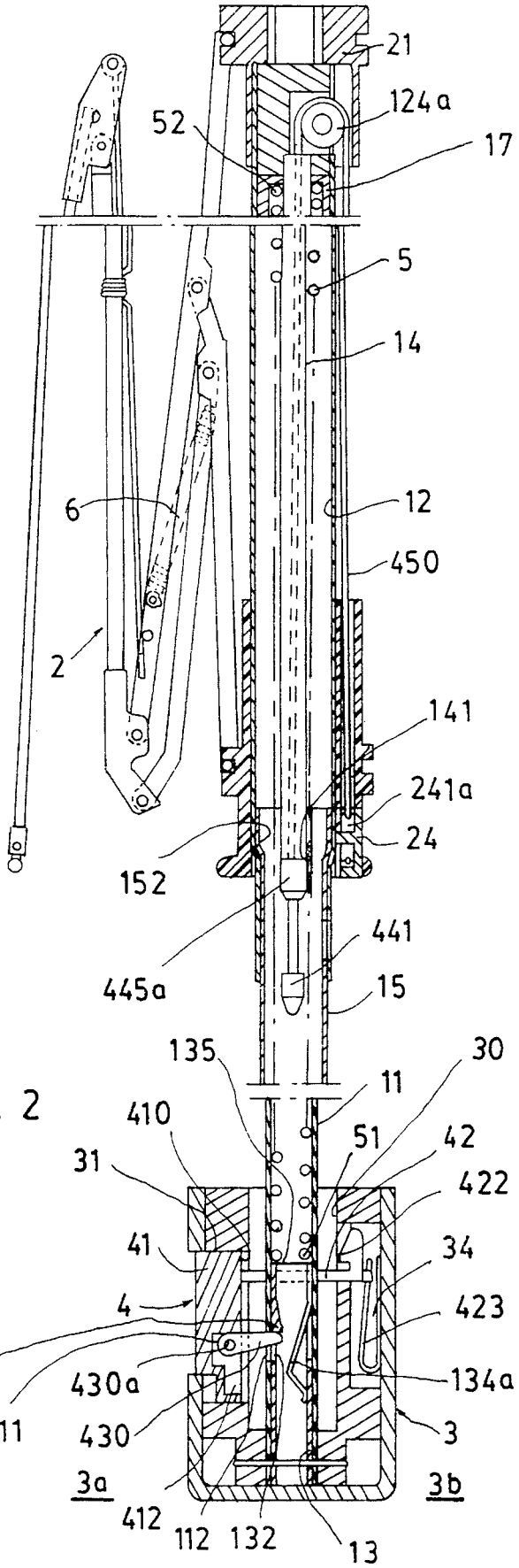
FIG. 2 shows a closed umbrella when closing the umbrella of FIG. 1.

When closing the umbrella from an opened state as from FIG. 1 to FIG. 2, the push button 41 is depressed to push the pushing rod 430 inwardly to disengage the locking head portion 441 from the triangular block portion 131 of the lower sleeve 13, thereby allowing the retraction restoring springs 6 for lowering the runner 24 and retracting the ribs 2 for closing the umbrella as shown in FIG. 2. The rope 450 is simultaneously pulled to raise the rope connector 455*a* to be retained on the lower sleeve end portion 141 of the upper sleeve 14.

The grip 3 is depressed as from FIG. 2 to FIG. 3 for resetting and compressing the extending spring 5 to fold the tubular shafts 12, 15, 11 to retract the wedge portion 422 to be engaged with the engaging holes 122, 153 of the upper and middle shafts 12, 15, thereby finally folding the upper, middle and lower shafts 12, 15, 11 at a folded state of the umbrella. The locking head portion 441 is re-locked on the triangular block portion 131 in the sleeve 13 (FIG. 3, 3A).

Figure 5:
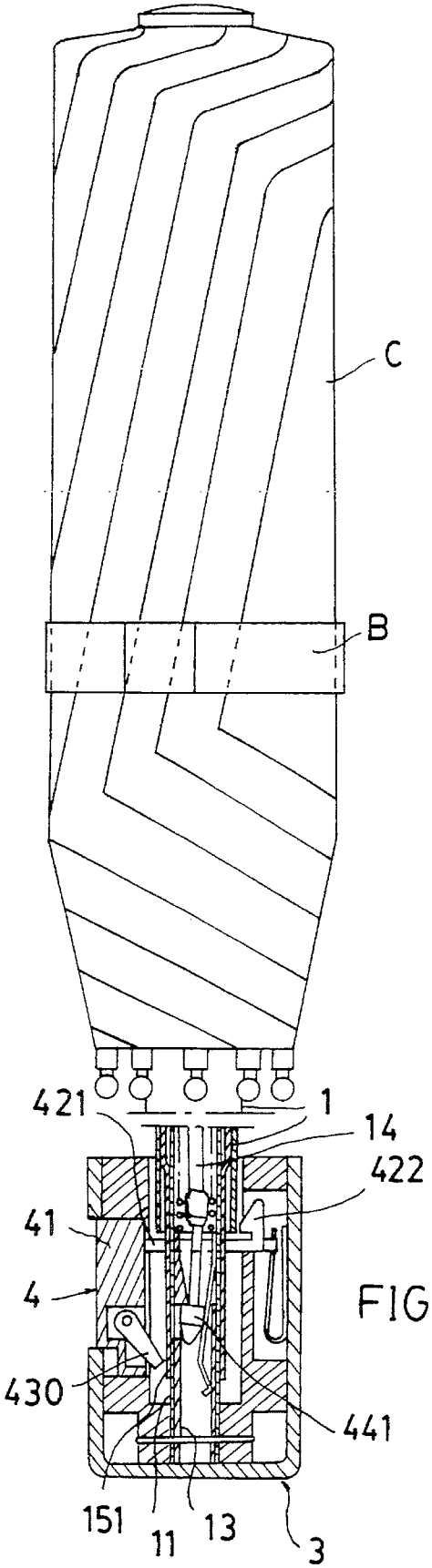
FIG. 5 shows a folded umbrella as fastened by a band around the umbrella cloth.
Figure 5A:
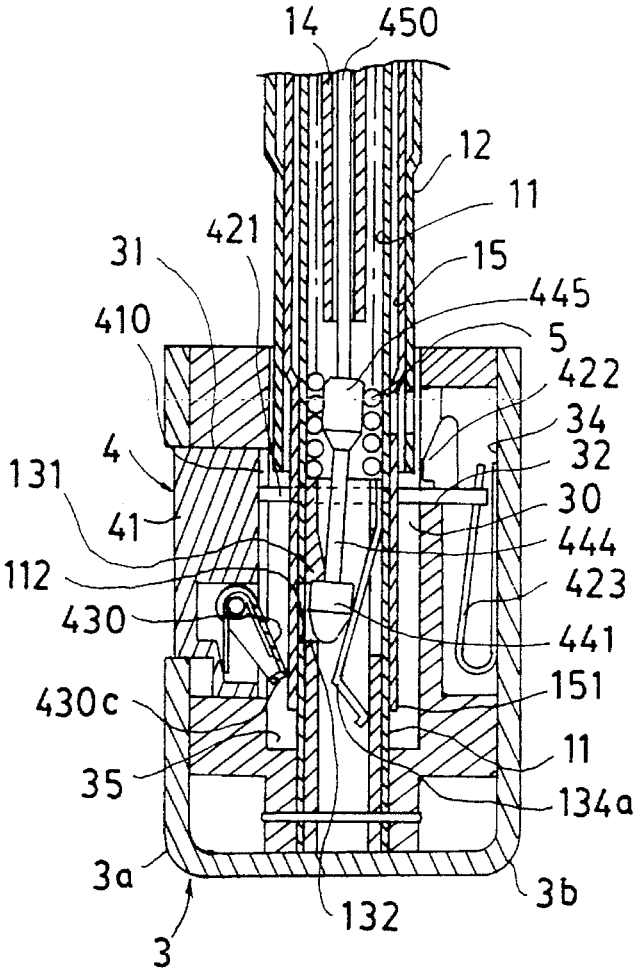
FIG. 5A is a partially enlarged view from FIG. 5.

The locking head portion 441 will be positioned to face the rod holes 132, 112 formed in the lower sleeve 13 and the lower shaft 11. Since the pushing rod 430 is downwardly biased as downwardly thrusted by the lower end portion 151 of the middle shaft 15, a depression on the locking head portion 441 will be retarded by the lower portion 151 of the middle shaft 15 which still shields the rod holes 132, 112, to thereby prevent a disengagement of the locking head portion 441 from the triangular block portion 131. Such an effect can be illustrated in FIGS. 5, 5A, when the folded umbrella is fastened by a band B, and a depression of the button 41 to disengage the wedge portion 422, the umbrella will still not be opened as fastened by the band B on the umbrella cloth C and the locking head portion 441 is still locked on the triangular block portion 131. A further depression of the button 41 will be "ineffective", since the pushing rod 430 has been downwardly biased as downwardly thrusted and retarded by the middle shaft 15 (FIGS. 5, 5A), being impossible to disengage the locking head portion 441 from the triangular block portion 131 and thereby preventing a false operation of the umbrella button 41.

The present invention is superior to a conventional automatic umbrella of the U.S. Pat. No. 5,267,583 with the following advantages:

1. The control means 4 has been simplified for a safe, reliable, and efficient operation and for a reduced production cost.

2. The rib assembly 2 is reinforced for a stable opening and a longer service life.

3. Some redundant or complex elements have been eliminated and the operating mechanism has been simplified for a compact and light umbrella with lower cost.

We claim:

1. An automatic umbrella comprising:

a central shaft means having an upper tubular shaft slidably telescopically engageable with a middle tubular shaft, said middle tubular shaft telescopically engageable with a lower tubular shaft, said lower tubular shaft secured on a grip and having a rod hole formed in a lower end portion of said lower shaft at a first side of the grip, said middle tubular shaft slidably engageable with the lower shaft having an engaging hole formed in a lower portion of said middle shaft at a second side of said grip, an upper tubular shaft slidably engageable with the middle tubular shaft having an engaging hole formed in the lower end portion of the upper shaft at a second side of the grip, and an inner block formed in an upper end portion of the upper shaft having an upper guiding roller rotatably mounted in the inner block, a lower sleeve fixed in the grip within the lower shaft having a triangular block portion formed in the lower sleeve inclined inwardly downwardly, an inner rod hole formed in the lower sleeve positioned below the triangular block portion adjacent to the rod hole and to a bottom portion of the grip at a first side of the grip, an upper sleeve fixed in the inner block of the upper shaft, and a coupling sleeve detachably engageable with an upper portion of said middle shaft and having an upper portion of said coupling sleeve adjacent to said inner block;

a rib assembly having at least a top rib pivotally secured to an upper notch fixed on a top portion of said upper shaft, a stretcher rib pivotally secured with said top rib and pivotally secured to a lower runner slidably held on said central shaft means, a middle rib secured to a middle joint member pivotally connected with the top rib, a rear rib secured to an outer joint member pivotally connected with the middle rib, a connection rib pivotally connected between the stretcher rib and the middle joint member, and a resilient rib connected between the top rib and the outer joint member;

an extending spring retained in between said coupling sleeve and said lower sleeve for operatively opening the umbrella, and said extending spring disposed around said upper sleeve;

a plurality of, retraction restoring springs each said retraction restoring spring having an inner spring end secured on a lug formed on said connection rib and an outer spring end secured to said top rib for operatively closing the umbrella from an opened state of the umbrella; and a control means including: a push button slidably held in a button hole formed in the grip at the first side of the grip; an opening controller having a pair of bifurcated members bifurcated towards the first side of the grip and slidably held in a central portion of the grip to be normally contacting with an inside button surface of the push button and slidably disposing about an outer circumferential surface of the upper shaft, a wedge portion tapered downwardly inwardly towards a center of the central shaft means and formed on a rear portion of the bifurcated members and engageable with each said engaging hole formed in said upper and middle shafts, and a controller restoring spring held in a spring socket formed in the grip at the second side of the grip for urging the wedge portion to be engaged with the engaging hole of the upper shaft when closing the umbrella, and for urging the bifurcated members forwardly to protrude the push button outwardly ready for a depression operation; a closing controller having a pushing rod pivotally secured in said push button and normally restored horizontally and protruding horizontally towards the second side of the grip through each rod hole formed in said lower shaft and in said lower sleeve; a locking head means having a locking head portion formed with an arcuate bottom portion on a bottom portion of the locking head portion and a locking shoulder portion on an upper portion of the locking head portion, and a rope connector secured with the locking head portion with a neck portion between the rope connector and the locking head portion; and a rope having a lower rope knot locked into a knot socket formed in the rope connector of the locking head means and having an upper rope end portion secured to the inner block adjacent to the upper notch by passing the rope through a central portion of the shaft means, the upper sleeve and deflectively winding the rope on the upper guiding roller formed on the inner block downwardly to the lower runner and then deflectively winding the rope upwardly through a lower guiding roller rotatably mounted on an integrally formed roller holder embedded in a bottom of the lower runner to be upwardly extended to the upper notch, said locking head portion, upon the folding of the umbrella, operatively biased by a resilient plate protruding inwardly from the lower sleeve at the second side of the grip to be locked on a triangular block portion formed on the lower sleeve at the first side of the grip; and the locking head portion operatively disengaged from the triangular block portion of the lower sleeve when thrusted by the pushing rod when closing an opened umbrella.

2. An automatic umbrella according to claim 1, wherein said coupling sleeve has a lower fork portion as bifurcated from the coupling sleeve to be detachably engageable with an upper enlarged portion of the middle shaft.

3. An automatic umbrella according to claim 1, wherein said top rib has a cross section of U shape and an outer bending edge portion adjacent to the middle joint member bent downwardly to be spaced between two longitudinal side walls of the top rib.

4. An automatic umbrella according to claim 1, wherein said outer joint member includes a pair of elongated lugs bifurcated downwardly from said outer joint member for holding an outer pressed end portion of the middle rib pivotally connected to the outer joint member.

* * * * *